US006880582B2

(12) United States Patent
Vanderjeugt et al.

(10) Patent No.: US 6,880,582 B2
(45) Date of Patent: Apr. 19, 2005

(54) CONNECTING MEANS FOR DETACHABLY CONNECTING CORDS OF A JACQUARD MACHINE

(75) Inventors: Bram Vanderjeugt, Ypres (BE); Yvan Lauwereys, Schellebelle (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 134 days.

(21) Appl. No.: 10/429,966

(22) Filed: May 6, 2003

(65) Prior Publication Data

US 2003/0221737 A1 Dec. 4, 2003

(30) Foreign Application Priority Data

May 6, 2002 (BE) ..... 2002/0299

(51) Int. Cl.[7] ..... D03C 13/00

(52) U.S. Cl. ..... 139/88; 139/59; 139/60; 139/61; 139/62; 139/85; 139/87

(58) Field of Search ..... 139/59–62, 85, 139/87, 88

(56) References Cited

U.S. PATENT DOCUMENTS

| | | | | | |
|---|---|---|---|---|---|
| 4,513,789 | A | * | 4/1985 | Bowen et al. | 139/85 |
| 4,770,213 | A | * | 9/1988 | Peter | 139/88 |
| 4,771,812 | A | * | 9/1988 | Yokoi | 139/82 |
| 5,152,324 | A | * | 10/1992 | Froment | 139/82 |
| 5,309,950 | A | * | 5/1994 | Bassi et al. | 139/88 |
| 5,373,871 | A | * | 12/1994 | Speich | 139/455 |
| 5,636,663 | A | * | 6/1997 | Lacroix | 139/86 |
| 5,671,782 | A | * | 9/1997 | Lemaire et al. | 139/85 |
| 5,791,382 | A | * | 8/1998 | Froment et al. | 139/85 |
| 6,186,188 | B1 | * | 2/2001 | Horter et al. | 139/85 |
| 6,318,415 | B1 | * | 11/2001 | Kutzleb et al. | 139/455 |

FOREIGN PATENT DOCUMENTS

| | | |
|---|---|---|
| DE | 4213958 | 4/1993 |
| EP | 0421370 | 4/1991 |
| EP | 0788562 | 8/1997 |
| WO | WO99/27170 | 6/1999 |

* cited by examiner

*Primary Examiner*—Danny Worrell
*Assistant Examiner*—Robert H. Muromoto, Jr.
(74) *Attorney, Agent, or Firm*—James C. Wray; Meera P. Narasimhan

(57) ABSTRACT

A first (1) and a second connecting means (2) which may be connected in a detachable manner in order to connect a first and a second cord, more particularly a lifting cord and a harness cord of a Jacquard machine, the first connecting means (1) comprising an elastically deformable coupling element (3) which may be received in a receiving part (4) of the second connecting means and may be retained in axial direction, the second connecting means (2) comprising a passage (5) through which the coupling element (3), compressed in the radial direction, may be moved to the receiving part (4) and the coupling element (3) in the receiving part (4) having the possibility of adopting a larger radial dimension than is necessary to be moved through the passage (5), so that the coupling element (3) snap-fits in the receiving part (4). In the receiving part (4), the coupling element (3), by rotation around the longitudinal axis (A), may be brought into a disengaging position in which it is not retained.

11 Claims, 5 Drawing Sheets

CONNECTING MEANS FOR DETACHABLY CONNECTING CORDS OF A JACQUARD MACHINE

This application claims the benefit of Belgian Application No. 2002/0299 filed May 6, 2002.

BACKGROUND OF THE INVENTION

This invention relates to a set of connecting means for detachably connecting cords of a Jacquard machine, comprising a first and a second connecting means, which are provided to be coupled together in a detachable manner with a first and a second cord respectively, the first connecting means comprising an elastically deformable coupling element, the second connecting means comprising a passage, through which the coupling element, compressed in a radial direction, may be shifted to a receiving part, and the coupling element in the receiving part having the possibility to adopt a larger radial dimension than in the said compressed situation.

A Jacquard machine comprises a large number of devices for lifting warp yarns. By means of a cord, each of these devices is connected to one or more harness cords, which are connected to heddles with respective heddle eyes, through which extend one or several warp yarns. When installing such a harness a large number of lifting cords have to be connected with harness cords. This is a very time-consuming operation with long idling periods of the weaving machines and a proportional loss of productivity as a consequence. In order that this connection of cords may be carried out quickly, various types of connecting means were developed. It is important that a reliable connection can be realized by means of these connecting means. Moreover these connecting means should be of a simple construction and be easily to manipulate. This invention relates more particularly to a set of connecting means to connect lifting cords and harness cords of a Jacquard machine in a detachable manner.

A similar set of connecting means is known, among others, from the European patent EP 0 788 562 B1. The first connecting means comprises an elongated inserting part, which ends in a radially enlarging head, while the second connecting means comprises a pair of co-acting springy clamping fingers designed to be pushed away from one another through the head of the first connecting means and to spring back once the head has passed the clamping fingers. This head is then retained in an axial direction by the springy clamping fingers springing back, so that the connecting means are coupled. To disconnect the connecting means the clamping fingers should be pushed away from one another by means of a slidable sleeve, so that the head may subsequently be drawn from the second connecting means between the clamping fingers.

An inconvenience of these connecting means is that the first connecting means is rather complicated, among others, because it should comprise a slidable sleeve. Another inconvenience is that the exact coupling of these connecting means depends on two elastically deformable clamping fingers.

In the international patent application WO 99/27170, a set of connecting means is described, having the characteristics indicated above. The first connecting means comprises a number of flexible projections, acting as coupling elements, while the second connecting means comprises an equal number of recesses. In their compressed situation, the flexible projections may be shifted towards the recesses and eventually spring back into these recesses. Then the connecting means are in a coupled position. Therefore the openings here function as the receiving part, namely the part in which the coupling elements may adopt a larger radial dimension.

These known connecting means further also comprise a number of grooves, recesses and projections for guiding the guiding means with respect to each another. Among others, these guiding means are necessary to transfer a further movement (a translation in the coupling direction) of the coupled connecting means with respect to one another, in a rotation of the connecting means with respect to one another. Because of this translating movement and the forced rotation associated with it, from the coupled position, the connecting means may be brought into a disconnecting position.

These known connecting means have the disadvantage that they are complicated and consequently also relatively expensive. An additional disadvantage is that these connecting means cannot be carried out very compactly (in the transverse direction) and, for instance, have an outer diameter of 8 to 10 mm. Because of this, the number of connecting means, which may be operated per unit of surface on a Jacquard machine, is rather limited. This is an important disadvantage, as it is a permanent aim to increase the number of hooks of a jacquard machine.

An additional disadvantage of these connecting means is that they cannot be easily disconnected. The connecting means are moving considerably with respect to each other before disconnection may be carried out. Another disadvantage is that the flexible projections possibly do not spring back after their deformation.

SUMMARY OF THE INVENTION

The purpose of the present invention is to provide a set of connecting means, which have not, the said disadvantages and by which a speedy and reliable connection of the cords in a Jacquard machine is possible.

This purpose is achieved according to the invention by providing such a set of connecting means, the receiving part of which is designed in such a manner that the coupling element in the receiving part may be rotated around its longitudinal axis in order to be brought from a coupling position into a disconnecting position and that the coupling element in the coupling position is retained in the receiving part in the axial direction, and in the disconnecting position is not retained in this receiving part.

With these connecting means no guiding means are necessary in order to obtain the rotation required for disconnection, so that these connecting means, compared with the connecting means already known, may be made simpler and consequently may also be produced cheaper. Because of this, they may be carried out being more compact in the transverse direction (e.g. with a maximum diameter of 6 mm). Therefore these connecting means allow for a larger number of hooks than the connecting means already known.

Further, the connecting means according to the invention are also easier to disconnect than the connecting means already known. A simple rotating movement (around the longitudinal axis) of the connecting means with respect to one another will do to bring the coupling element into its disconnecting position. As during this rotation, the coupling element remains in the receiving part, this rotation may occur without any deformation of the coupling element. This also is in favour of a speedy disconnection without any problems.

The connecting means according to the present invention moreover comprise only one elastically deformable part, which will favour the reliability of the connection and will simplify the production. These connecting means may be disconnected very quickly in one swift movement and will produce an efficient and reliable connection of the cords of a Jacquard machine.

With a set of connecting means according to the present invention, one of the connecting means has to be rotated around its longitudinal axis with respect to the other connecting means before they may be disconnected. In other words, a rotating movement has to be performed, contrary to the translating movement with the connecting means already known, in order to perform a disconnection. This practically avoids an undesired disconnection from being performed.

In a preferred embodiment of the set of connecting means according to the present invention, the coupling means comprises at least one radially projecting bumper edge, the second coupling means comprises at least one retaining edge, provided for retaining, in an axial direction, a bumper edge of the coupling means situated in a coupling position in the receiving part, in order to prevent the disconnection of the connecting means and the connecting means are carried out such that the coupling means in the receiving part, may be brought into a disconnecting position by rotation around the longitudinal axis of the one connecting means with respect to the other, not any bumper edge of the coupling element being stopped by a retaining edge, so that the said disconnection is no longer prevented.

With such a set of connecting means, the passage preferably is provided to let pass the coupling element in a non-deformed situation in the direction of the disconnection, when the coupling element has been rotated into the said disconnecting position in the receiving part.

When disconnecting, the first connecting means may be withdrawn freely from the second connecting means. Because of this, a particular user-friendly set of connecting means is obtained.

Preferably, the second connecting means is provided with at least one cam, preventing a rotating movement around the longitudinal axis of the one connecting means with respect to the other when the connecting means have been connected. Because of this, bringing the coupling element of the first connecting means into the position for disconnection by simply rotating the first connecting means with respect to the second connecting means is made impossible. To disconnect the connecting means an additional operation is required.

Preferably, the said cam is provided in such a manner that it is situated next to the coupling element, when the bumper edge of the coupling element strikes against the retaining edge, and that by a further axial movement in the connecting direction of the one connecting means with respect to the other, the coupling element may be brought beyond the cam in order to realize the said rotation.

In a preferred embodiment, at least one of the connecting means is provided with a springy element, which exercises a spring force on the other connecting element, which pushes the connecting means, coupled with respect to one another, into the disconnecting direction.

In a preferred embodiment of a set of connecting means according to the present invention, the coupling element is provided at the extremity of an inserting part of the first connecting means, and towards its extremity, the coupling element has a narrowing form having a non-circular cross-section.

For instance, a set of connecting means according to the present invention is carried out in that the coupling element of the first connecting means comprises two radially projecting flanks with respective end faces, forming two radially projecting bumper edges, in that the receiving part of the second connecting means comprises two windows, so that a respective flank of the coupling element may be situated in each window, the limiting edge of each window being situated opposite the bumper edge acting as a retaining edge for retaining the coupling element.

The said limiting edge of at least one window then preferably comprises a first edge part, acting as a retaining edge and which is changing stepwise into a second edge part, so that this step will form the said cam, by which a rotation of the connecting means with respect to one another will be prevented.

With these connecting means the first and/or the second connecting means may comprise means for a cord to be attached to them. The first and/or the second connecting means may also be made, at least partly, of synthetic material and comprise a cord, extruded into the synthetic material.

In the following detailed description a preferred embodiment of a set of connecting means according to the present invention is described in detail. Its only purpose is to clarify the said characteristics of the invention by means of a concrete embodiment. It should therefore be obvious that nothing in this description may be interpreted as being a restriction of the scope of the patent rights expressed in the claims, nor as a restriction of the field of application of the present invention.

BRIEF DESCRIPTION OF THE DRAWINGS

In this description, by means of reference numbers, reference is made to the attached drawings of which.

DETAILED DESCRIPTION OF THE PREFERRED EMBODIMENTS

Figure 1:
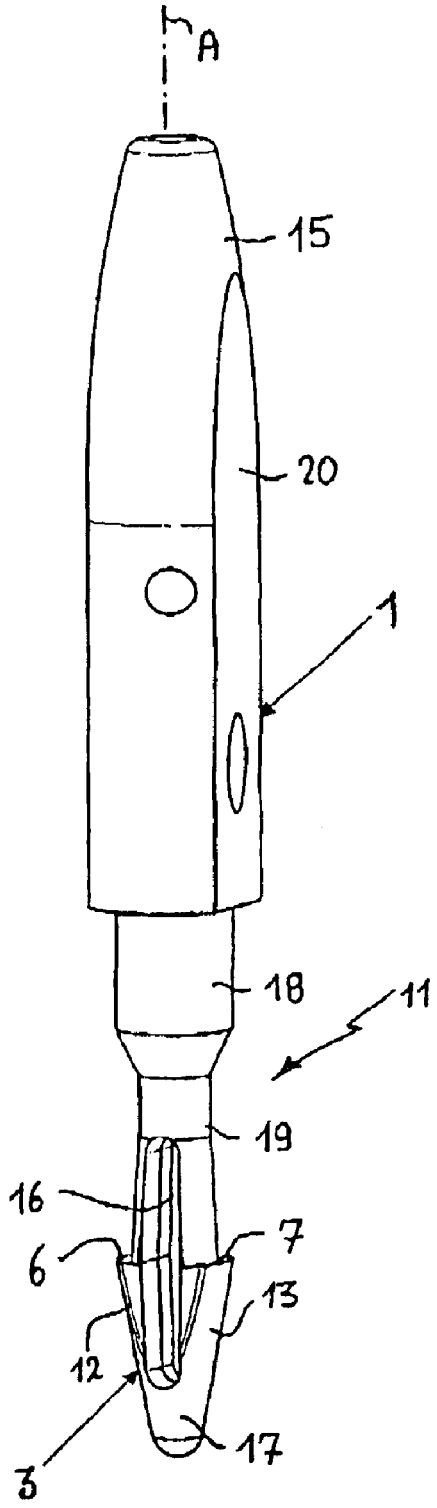
FIG. 1 is a perspective drawing of a first connecting means.

The first connecting means (1) comprises an elongated body (15) with flattened sides (20), at the bottom changing into a narrower inserting part (11). At the top, the body (15) is connected to a lifting cord of a Jacquard machine, not represented in the drawings. The inserting part (11) has an upper cylindrical part (18) changing into a lower part (19) with smaller lateral dimensions than the upper part (18). In this lower part (19) an elongated opening (16) extending according to the longitudinal direction (A) has been provided. On both sides of the opening (16) a respective flank part (12), (13) has been formed on the lower part (19). These flank parts (12), (13) are projecting in opposite radial directions with respect to the upper walls of the lower part (19). The flank parts (12), (13) have a respective top surface (6), (7) being situated practically across the longitudinal direction (A) of the first connecting means (1). As will be explained hereafter, these top surfaces (6), (7) are retained by a retaining edge (8) of the second connecting means (2) when these connecting means have been coupled.

These flank parts (12), (13) are narrowing in the direction of the extremity of the inserting part (11) and are changing into a common point (17) which forms the extremity of the inserting part (11), situated beyond the opening (16). The flank parts (12), (13) and the point (17) together constitute a whole having the form of an arrow and are made of elastically deformable material. In this description, this entity is called the coupling element (3).

Figure 2:
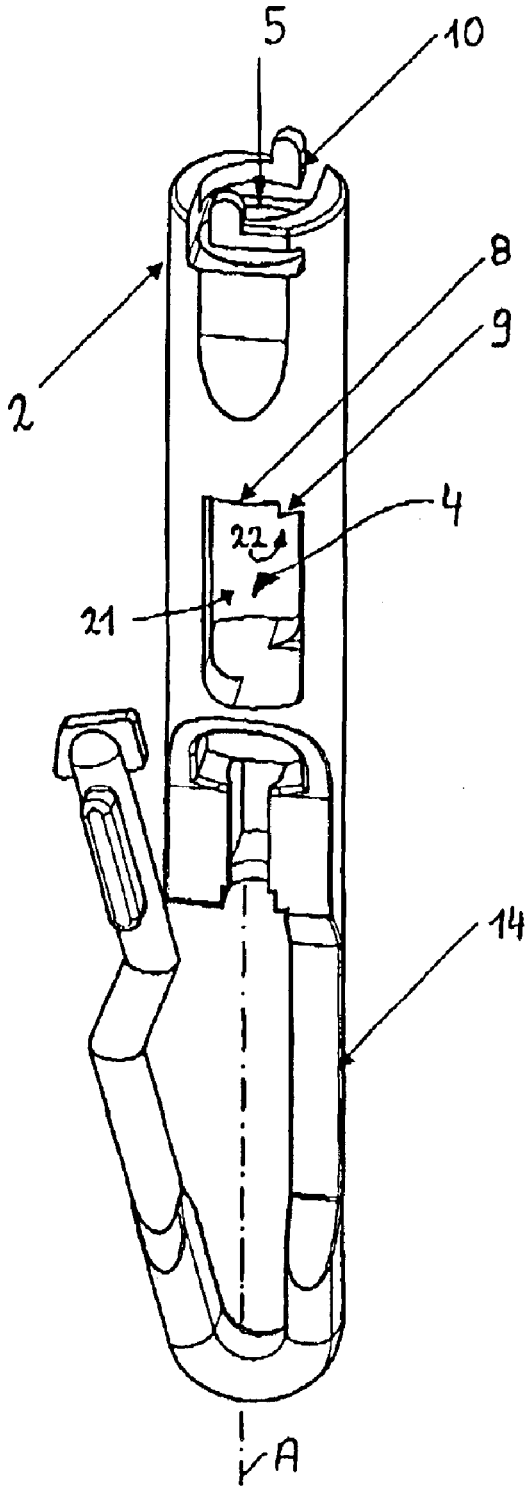
FIG. 2 is a perspective drawing of a second connecting means.

As is best to be seen in FIG. 2, the second connecting means (2) has an upper part with an internal space in which the inserting part (11) of the first connecting means (1) may be received and a lower part with a so-called carbine coupling (14) for attaching one or several harness cords (not represented in the figures). The internal space consists of a passage (5), which exits at the top of the connecting means (2) on the one side and in a receiving part (4) into which the coupling element (3) may snap-fit and may be retained in the axial direction on the other side.

In the walls of the second connecting means (2), near the receiving part two windows (21), (22) have been provided, situated opposite one another. These windows (21), (22) have an upper limiting edge (8) acting as a retaining edge for retaining the bumper edges (6), (7) of the coupling element, when this coupling element is situated in the receiving part (4). This retaining edge (8) changes stepwise into an edge part situated lower, so that a cam is formed.

Figure 3:
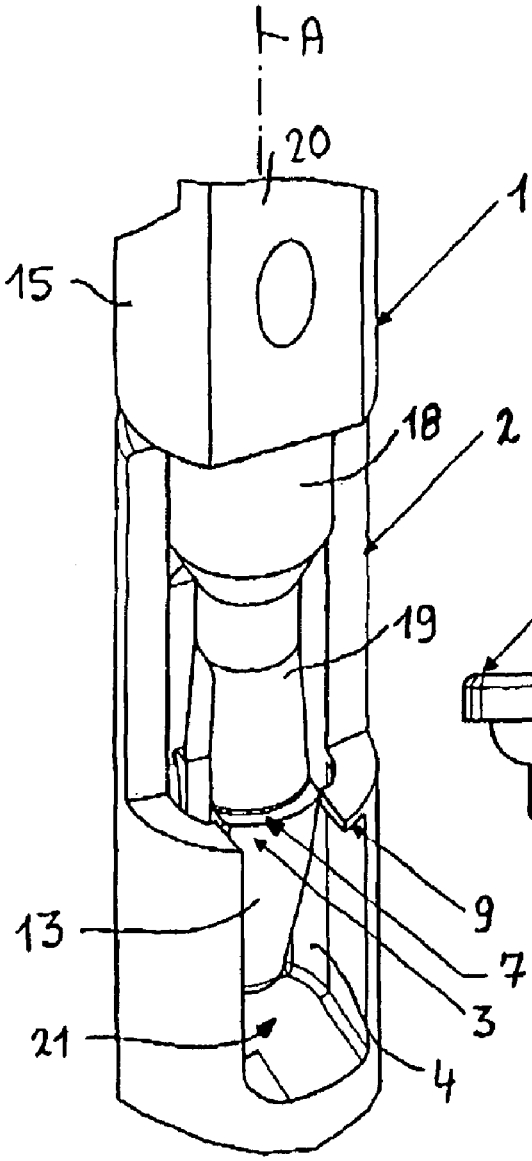
FIG. 3 is a perspective drawing of a part of the coupled connecting means, when the coupling element is situated in the coupling position, the foremost wall of the second connecting means being partly removed.
Figure 4:
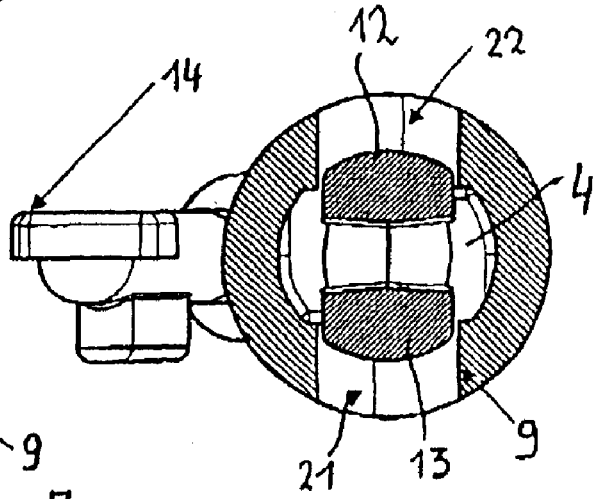
FIG. 4 is a horizontal cross-section of the coupled connecting means of FIG. 3, according to a horizontal plane through the coupling element of the first connecting means.
Figure 7:
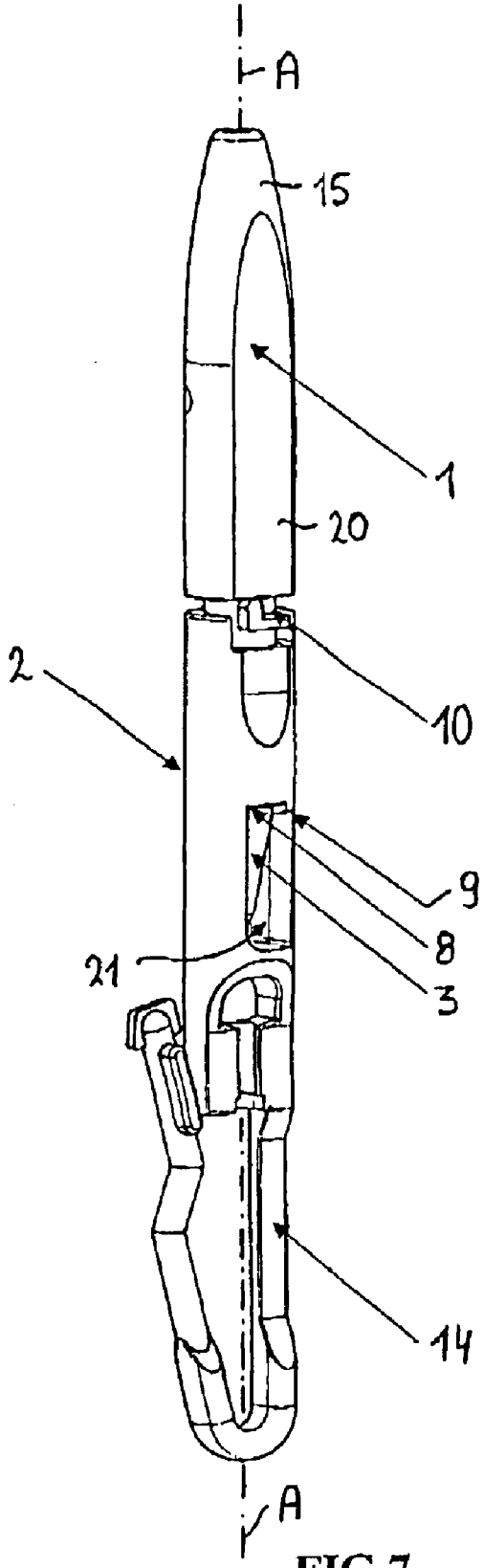
FIG. 7 is a perspective drawing of the coupled connecting means.

Through the passage (5) accessible from above, the coupling element (3) may be brought into the receiving part (4). This passage (5) has such lateral dimensions that, when the coupling element (3) is so orientated with respect to the second connecting means (2), that the flanks (12), (13) are situated above the windows (21), (22) (when it is situated in the coupling position), the coupling element (3) is elastically deformed in such a manner in the passage, so that its radial dimensions are reduced. The moment the flanks (12), (13) are brought beyond the passage (5), they end up in a respective window (21), (22) and resume their original radial dimensions, so that the bumper edges (6), (7) are retained by the retaining edges (8) of the respective windows. In that manner, the coupling element (3) of the first connecting means (1) snap-fits into the receiving part (4) of the second connecting means (2). The coupling element (3) is situated in the coupling position (3) in the receiving part (4), while the inserting part (11) extends in the passage (5). This situation is represented in the FIGS. 3, 4 and 7.

The second connecting means (2) has a springy lip (10) at the top, which is situated such that it is pushed down by the lower edge of the body (15) of the first connecting means (1) when the connecting means (1), (2) are coupled. The spring force exerted by this lip (10) pushes the connecting means away from one another in the disconnecting direction, because of which the bumper edges (6), (7) are pushed against the retaining edges (8) and because of which undesired axial movements of the connecting means with respect to one another are prevented. The cam (9) prevents the two connecting means (1), (2) from being rotated around the longitudinal axis (A) with respect to one another.

Figure 5:
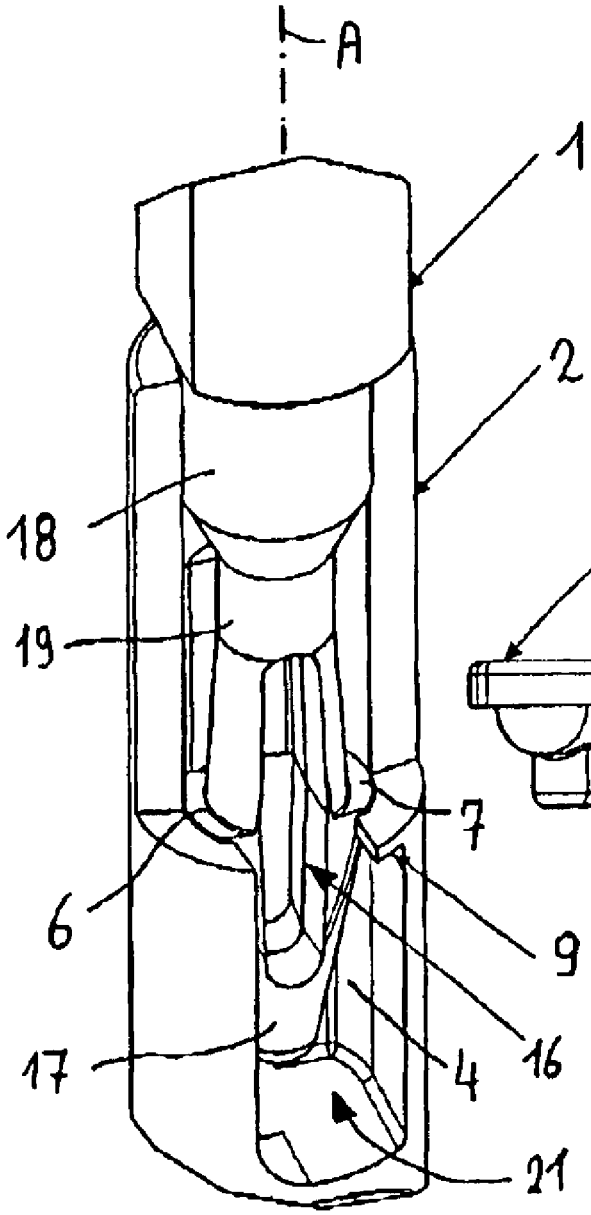
FIG. 5 is a perspective drawing of a part of the coupled connecting means, when the coupling element is situated in the disconnecting position, the foremost wall of the second connecting means being partly removed.
Figure 6:
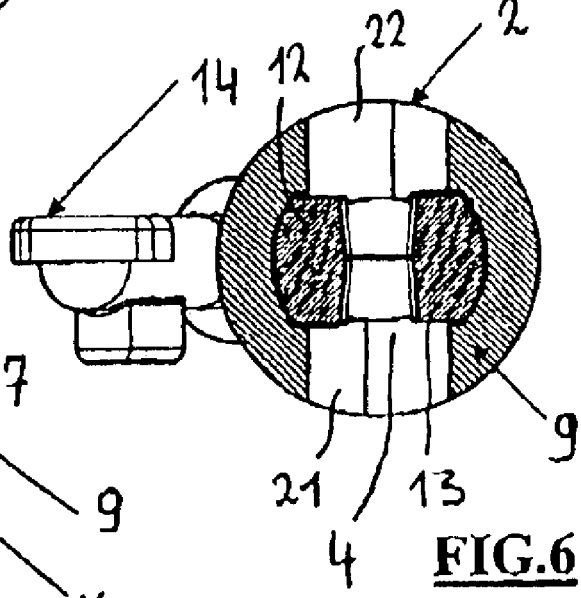
FIG. 6 is a horizontal cross-section of the coupled connecting means of FIG. 5, according to a horizontal plane through the coupling element of the first connecting means.

In order to disengage the connecting means (1), (2), they must be pushed further towards one another in the coupling direction against the spring force of the springy lip (10), until the top of the coupling element (3) is brought beyond the cam (9). Than the first connecting means (1) may be rotated around its longitudinal axis (A) in the receiving part (4) into the position represented in the FIGS. 5 and 6. In this position, called the disengaging position, the coupling element (3) may be drawn freely and without any deformation along the passage (5) from the second connecting means (2).

These connecting means (1), (2) enable to realize a particularly reliable connection of a lifting cord and a harness cord of a Jacquard machine by one swift inserting movement according to the longitudinal axis of the connecting means (1), (2). Moreover, these connecting means are of a rather simple construction and user-friendly.

What is claimed is:

1. A set of connecting means (1), (2) for detachably connecting cords of a Jacquard machine, comprising a first (1) and a second connecting means (2), which are provided to be coupled, in a detachable manner, to a first and a second cord respectively, the first connecting means (1) comprising an elastically deformable coupling element (3), the second connecting means (2) comprising a passage (5), through which the coupling element (3), compressed in a radial direction, may be shifted to a receiving part (4), and the coupling element (3) in the receiving part (4) having the possibility to adopt a larger radial dimension than in the said compressed situation, wherein the receiving part (4) is designed in such a manner that the coupling element (3) may be rotated around its longitudinal axis (A) in order to be brought from a coupling position into a disengaging position and in that the coupling element (3) is retained in the receiving part (4) in the coupling position in axial direction and is not retained in this receiving part (4) in the disengaging position.

2. A set of connecting means according to claim 1, wherein the coupling element (3) comprises at least one projecting bumper edge (6), (7), and wherein the second connecting means (2) comprises at least one retaining edge (8) which has been provided to retain, in the axial direction, a bumper edge (6), (7) of the coupling element (3), placed in a coupling position in the receiving part (4), in order to prevent the connecting means from disengaging and in that the connecting means (1), (2) are carried out such that the coupling element (3) in the receiving part (4) may be brought into a disengaging position by a rotation around the longitudinal axis (A) of the one connecting means with respect to the other, not a single bumper edge (6), (7) of the coupling element (3) is retained by a retaining edge (8), so that said disengaging will be no longer prevented.

3. A set of connecting means according to claim 1, wherein the passage (5) is designed to let pass the coupling element (3) in a non-deformed condition in the disengaging direction, when the coupling element (3) is situated in the disengaging position in the receiving part (4).

4. A set of connecting means according to claim 1, wherein the second connecting means (2) is provided with at least one cam (9) preventing a rotation around the longitudinal axis of the one connecting means with respect to the other when the connecting means (1), (2) are coupled.

5. A set of connecting means according to claim 4, wherein the said cam (9) is situated next to the coupling element (3) when the bumper edge (6), (7) of the coupling element (3) strikes the retaining edge (8) and in that by a further axial movement in the coupling direction of the one connecting means with respect to the other one, the coupling element (3) may be brought beyond the cam (9) in order to realize said rotation.

6. A set of connecting means according to claim 1, wherein at least one of the connecting means (1), (2) is provided with a springy element (10) exercising a spring force on the other connecting element (2), (1) which pushes the coupled connecting means (1), (2) in the disengaging direction with respect to one another.

7. A set of connecting means according to claim 1, wherein the coupling element (3) has been provided on the extremity of an inserting part (11) of the first connecting means (1) and in that the coupling element (3) has a form, narrowing towards its extremity with a non-circular cross-section.

8. A set of connecting means according to claim 1, wherein the coupling element (3) of the first connecting means (1) comprises two radially projecting flanks (12), (13) with respective end faces constituting two radially projecting bumper edges (6), (7), in that the receiving part (4) of the second connecting means (2) comprises two windows (21); (22), so that in each window a respective flank (12) ,(13) of the coupling element may be situated, the limiting edge of each window, situated opposite the bumper edge (6), (7), is acting as a retaining edge (8) for retaining the coupling element (3).

9. A set of connecting means according to claim 8, wherein the said limiting edge of at least one window (21), (22) comprises a first edge part, acting as a retaining edge (8) and is changing stepwise into a second edge part, and in that this step constitutes said cam (9) by which a rotation of the connecting means with respect to one another is prevented.

10. A set of connecting means according to claim 1, wherein the first (1) and/or the second connecting means (2) comprise(s) means (14) for a cord to be attached to it.

11. A set of connecting means according to claim 1, wherein the first (1) and/or the second connecting means (2) is (are) made of synthetic material and contain(s) a cord extruded in the synthetic material.

* * * * *